United States Patent [19]

Green et al.

[11] Patent Number: 4,983,222

[45] Date of Patent: Jan. 8, 1991

[54] VAPOR SOLVENT DECONTAMINATION OF PCB TRANSFORMER COMPONENTS

[75] Inventors: Gregory R. Green; George R. Green, both of Kirtland, Ohio

[73] Assignee: Union Carbide Chemicals and Plastics Company Inc., Danbury, Conn.

[21] Appl. No.: 181,750

[22] Filed: Apr. 14, 1988

[51] Int. Cl.[5] ..... B08B 3/08

[52] U.S. Cl. ..... 134/22.1; 134/12; 134/22.19; 134/31; 134/40; 134/109

[58] Field of Search ..... 134/12, 221, 31, 109, 134/37, 38, 40, 254; 252/153, 160, 170, 171, 172, 364, DIG. 9, 130, 140

[56] References Cited

U.S. PATENT DOCUMENTS

| | | | |
|---|---|---|---|
| 3,957,531 | 5/1976 | Tipping | 134/11 |
| 4,425,949 | 1/1984 | Rowe, Jr. | 134/12 |
| 4,483,717 | 11/1984 | Olmstead | 134/12 |
| 4,498,934 | 2/1985 | Potts | 134/30 |
| 4,655,956 | 4/1987 | Basu et al. | 134/12 |
| 4,685,972 | 8/1987 | Fowler | 134/12 |
| 4,739,782 | 4/1988 | Nourie | 134/140 |
| 4,753,735 | 6/1988 | Figiel | 134/12 |
| 4,798,218 | 1/1989 | Sauvan | 134/130 |
| 4,826,538 | 5/1989 | Sanders et al. | 134/42 |

*Primary Examiner*—Asok Pal

*Attorney, Agent, or Firm*—Clement J. Vicari

[57] ABSTRACT

A method for decontaminating PCB containing transformers. The transformer is initially cleaned using a vapor degreasing solvent. The internal parts are removed and given a second cleaning which combines vapor degreasing with mechanical tumbling. The transformer and its parts are cleaned to less than 10 $\mu g/100$ $cm^2$ PCB. These cleaned parts are reclaimed rather than disposed of as toxic waste.

5 Claims, 2 Drawing Sheets

VAPOR SOLVENT DECONTAMINATION OF PCB TRANSFORMER COMPONENTS

FIELD OF INVENTION

The invention relates in general to electrical apparatus, such as transformers, and more particularly to the removal of residual polychlorinated biphenyls from transformer components.

BACKGROUND OF THE INVENTION

Since 1929, polychlorinated biphenyls (PCB) have been produced industrially. The outstanding properties of PCBS include thermal stability, resistance to oxidation, acid, bases and other chemical agents and excellent di-electric properties. Because of these properties, PCB fluids were used extensively for electrical transformers and capacitors.

The toxicity of PCBs has been known for several decades. PCBs cause yellow atrophy of the liver, fatty degeneration of the liver and dermatitis. In addition PCB is a suspected carcinogen. In 1966, the presence of PCB in environmental samples was discovered. Concern in the late 1960s and early 1970s about potential environmental hazards, coupled with its long-term stability, resulted in the 1976 ban on PCB manufacture and use (15 U.S.C.A. §2605(e)(2)(A)).

The largest remaining source of PCBs is liquid cooled electric transformers. Under current Environmental Protection Agency (EPA) regulations, there are two alternatives for possessors of PCB containing transformers, retrofill or replacement. Retrofill of existing equipment is usually the least costly and easiest for oil and Askarel ® filled transformers.

There are numerous methods available for retrofilling PCB containing transformers, for example, U.S. Pat. Nos. 4,685,972, 4,124,834 4,425,949 and 4,483,717. These methods deal with removing the PBC liquid, flushing the transformer and refilling with a non-PBC liquid. All of these methods are specifically aimed at decontaminating useful equipment. More particularly, the novelty of those methods is frequently a more efficient or thorough process or a process that allows the transfomer to remain in service during the decontamination. The present invention does not pertain to this category of transformers.

Retrofilling may not be suitable for all PCB containing transformers. Transformers in poor condition, or which have failed, or which are no longer useful require replacement and disposal of the removed carcasses.

Disposal of replaced transformers has long presented the owner with a dilemma. Current EPA regulations allow for disposal of PCB transformers in Toxic Substances Control Act approved landfills, but only after draining and an 18 hour rinse. Although landfill is authorized, this disposal method is not eithout substantial potential for long term liability. The transformer carcass can still contain up to 2% of its nameplate volume (20 to 100 lbs) soaked within its internals and the original owner remains responsible, jointly and severally, under the Comprehensive Environmental Response Compensation and Liability Act (CERCLA or "Superfund").

The present invention is directed at decontaminating the components of PCB containing transformers. Once the transformers are decontaminated, the components can be disposed of as non-toxic, non-hazardous waste.

SUMMARY OF THE INVENTION

The invention consists of a process to recover reclaimable material from PCB containing transformers and to reduce the volume of materials which are subject to EPA regulations to a minimum.

The transformer is drained and given an intial cleaning. The transformer internal parts are removed and cleaned a second time as is the empty transformer casing. Recoverable materials such as aluminum and copper are cleaned to less than 10 $\mu g$ /100 $cm^2$ PCB. This allows these metals to be recalimed rather than buried. Almost all of the remaining non-metallic materials are combustible solids or liquids, both of which can be destroyed by incineration.

First, a PCB containing transformer is drained of any residual liquid. The drained transformer is placed into the primary cleaning tank where solvent is used as a vapor/spray degreaser to remove PCBs from the transformer.

After completing this intial cleaning process, the transformer core and wire coils are separated from the transformer casing. The casing is returned to the primary cleaning tank for further claeaning by vapor/-spray degreasing.

The insulation on the wire coils is mechanically removed. The transformer core is dissembled. The transformer core metal components, the bare wire coils and any miscellaneous metal parts are placed into the secondary cleaning station for further cleaning.

The secondary cleaning station is a vapor/degreaser consisting of three separated sections. The loose parts are placed into a basket and then into the third section of the secondary cleaning station. The baskets are tumbled while in the secondary cleaning station. The decontamination process consists of solvent degreasing enhanced by the mechanical action of the tumblers. The parts are sequentially processed from section three to section two and then to section one of the secondary cleaning station. The solvent cascades from section one to section two and then section three. As the parts progress through the three sections of the secondary cleaning station, the parts are processed by progressively cleaner solvent which improves the PCB removal rate.

The contaminated solvent is processed in an isothermal separator to separate the PCB from the solvent. The cleaned solvent is returned to the cleaning station for further use. The still bottoms with high concentrations of PCBs are stored for future shipment and incineration.

The transformer casing and dissembled parts are processed until the PCB levels are less than 10 $\mu g/100\ cm^2$.

The cleaned metal is recycled since it is no longer hazardous waste. Any combustible solids such as paper, gaskets, insulation and wood, are collected along with any PCB liquids drained form the transformer and the PCB contaminated still bottoms. These combustible solids and PCB liquids are destroyed at an EPA approved incinerator.

Upon completion of the transformer cleaning process, there are no materials remaining that require disposal as hazardous waste by being buried at a landfill.

DETAILED DESCRIPTION OF THE INVENTION

Figure 1:
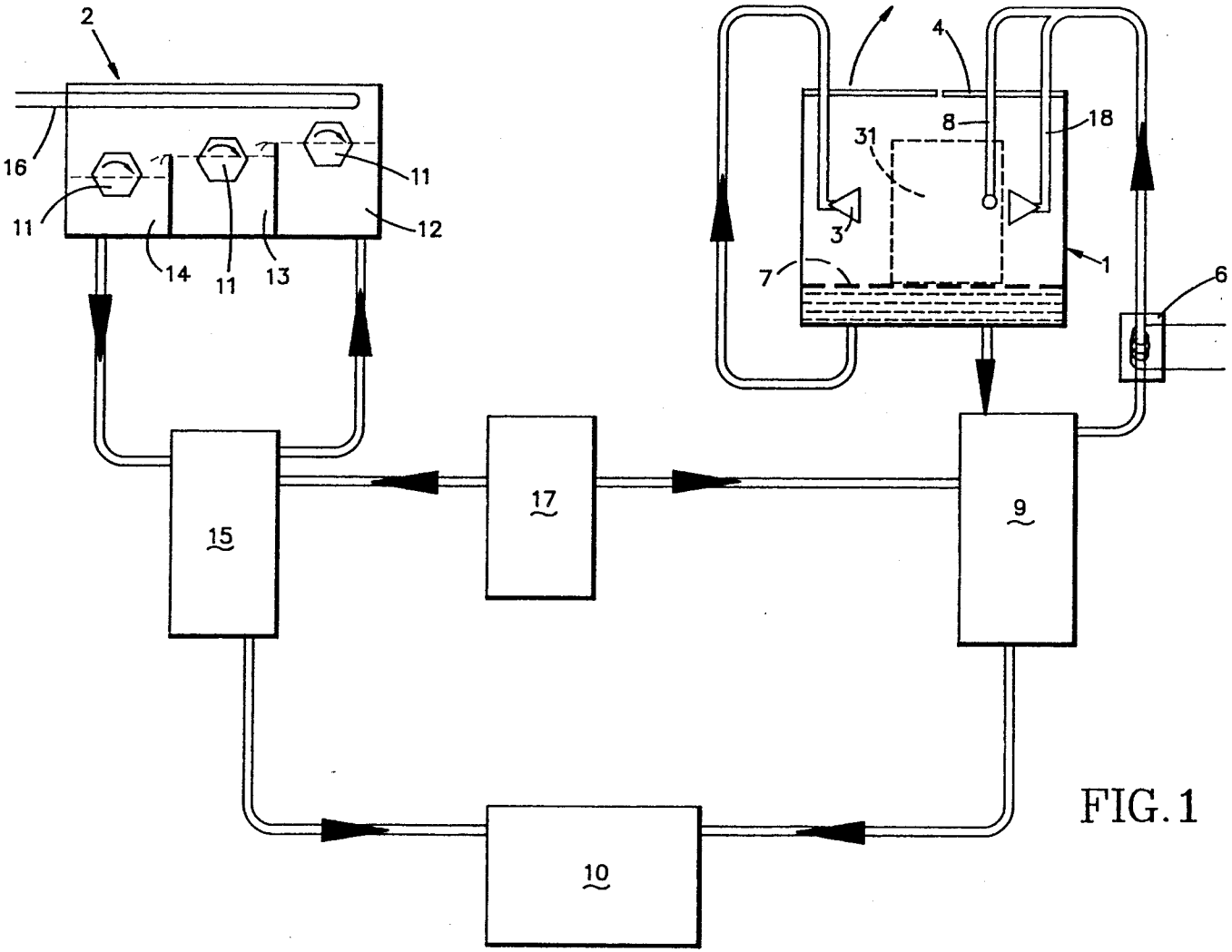
FIG. 1 is a diagram of a process for the decontamination of PCB containing transformers.
Figure 2:
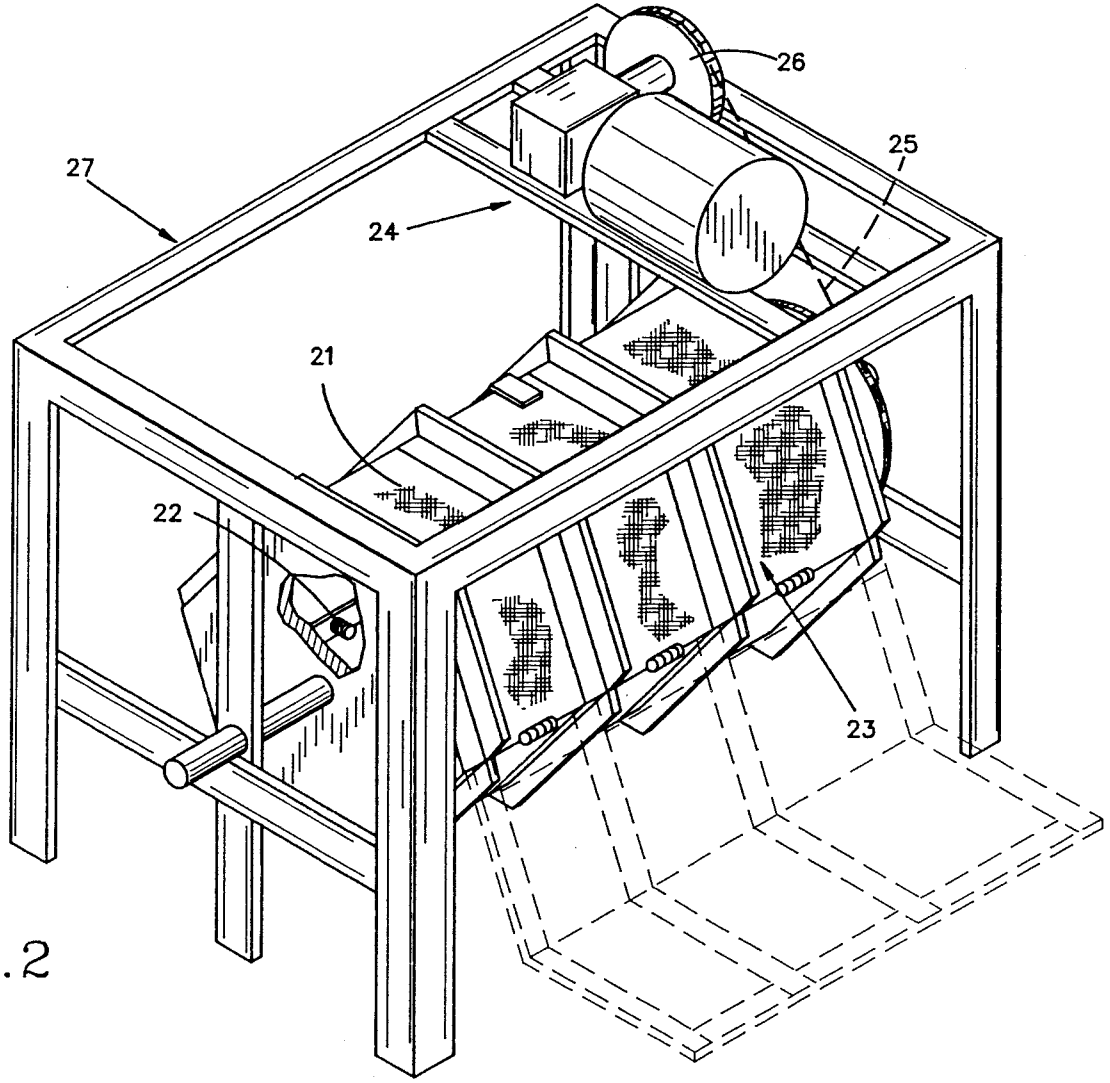
FIG. 2 is a perspective view of the tumbling basket.

The PCB containing transformer is initially drained of any residual liquids. Tupically, 1 gallon or less of liquid is drained. The drained liquid is transferred to a holding tank 10 for eventual disposal by incineration.

The transformer bottom valves and cover are removed. If additional drainage is required, a small hole is drilled in the bottom of the transformer. The transformer 31 is then placed into the primary cleaning tank 1.

The exterior of the transformer and all accessible interior surfaces are washed with liquid solvent using a spray wand 3. The solvent is taken from the bottom of the primary cleaning tank, below a false bottom 7. After this initial wash, the vapor hose 8 is placed inside the transformer, the primary cleaning tank cover 4 is closed and heated liquid solvent provided by an isothermal separator 9 is circulated through the transformer for 30 to 90 minutes.

Clean solvent vapor is then circulated through the primary cleaning tank 1. The primary cleaning tank operates as a vapor/degreaser for 4 to 8 hours. An isothermal separator 9 provides clean solvent to the vapor hose 8 through heater 6. The isothermal separator takes a suction from the bottom of the primary cleaning tank whenever the separator requires additional solvent. The still bottoms containing high concentrations of PCBs are stored 10 until shipped for eventual destruction. Additional clean solvent is provided to the isothermal separator 9 as needed from a makeup tank 17.

The transformer casing 31 is drained and after driving, the transformer is removed from the tank. Typically, this first cleaning reduces PCB levels from the range of 600,000 ppm to around 10,000 ppm.

The transformer is dissembled and all external parts, bushings, nuts, bolts, name plates, etc are removed. Internal parts are also removed. Combustible meaterials such as gaskets, loose insulation, paper and wood are removed and stored for eventual disposal as PCB containing solids.

The internals of a transformer consist primarily of the transformer core. The transformer core is dissembled to separate the wire coils from the metal laminations. The laminations, nuts, bolts and other miscellaneous metal parts are ready for second stage cleaning in the secondary cleaning station 2.

The wire coils coated with insulating material which is removed by mechanical abrasion such as wire brushing. The insulation is collected and held for eventual disposal as PCB containing solids. The stripped wire coils are ready for second stage cleaning in the secondary cleaning station 2.

The miscellaneous metal parts, such as nuts and bolts, along with the metal laminations and stripped wire coils are placed into a tumbling basket 11. The tumbling basket is then loaded into the secondary cleaning station 2. The secondary cleaning station is a vapor/degreaser cleaning tank divided into three sections 12, 13, 14.

The parts to be cleaned are placed into section three (14) of the secondary cleaning station 2. The parts are cleaned by both the vapor/degreasing action of the solvent and the mechanical action of tumbling when the basket 11 is rotated. The baskets are rotated horizontally at two rpm while in the secondary cleaning station. After a cleaning cycle of 30 minutes, the tumbling basket is transferred to section two 13 for a 15 minute cleaning and then to section one 12 for a final 15 minute cleaning cycle. Clean heated liquid solvent is supplied to section one 12 of the secondary cleaning station by an isothermal separator 15. The solvent overflows from this section into section two 13 and then into section one 14. This results in the parts being cleaned by progressively cleaner solvent, resulting in more efficient decontamination. Makeup to the isothermal separator 15 is taken from section three 14 of the secondary cleaning station 2, which contains the most contaminated solvent. The still bottoms with high concentrations of PCBs are stored 10 for future shipment and incineration.

The tumbling baskets 11 are partially immersed in liquid solvent. Cooling coils 16 are provided in the vapor zone of the secondary cleaning station 2 to condense any solvent vapor. The condensed solvent drips into the region of the secondary cleaning station that is below the cooling coils.

The tumblers 11 are six-sided hexagon shaped baskets sided with a wire mesh screen 21. A drive motor and gear assembly 24 are mounted on an external frame 27. A drive chain 25 and drive sprocket 26 in conjunction with the drive motor rotate the tumbling basket 11 horizontally at 2 rpm while in the secondary cleaning station. One section 23 of the tumbling basket is hinged in order to provide access for inserting and removing parts. Internal members 22 are provided to enhance the tumbling action and prevent the parts from bunching together.

The empty transformer shell is returned to the primary cleaning tank 1 for a second cleaning. The transformer shell is washed using a second spray wand 18 applying clean liquid solvent supplied by the isothermal separator 9. The inside and outside of the transformer shell is washed three times for 10 to 15 minutes each time. The solvent vapor hose 8 is then placed into the transformer shell and clean solvent vapor from the isothermal separator 9 is circulated into the primary cleaning tank 1. This vapor/degreasing cycle is continued for 4 to 8 hours.

After the transformer shell and parts complete the decontamination process, the surfaces are tested for PCB contamination. If the PCB level exceeds 10 $\mu g/100\ cm^2$, the parts are returned to the primary cleaning tank 1 or the secondary cleaning station 2 for additional decontamination.

The process of decontaminating the transformers uses trichloroethylene as the solvent. Trichloroethylene was chosen for its low boiling point, 180° F., which makes it relatively easy to recycle the trichloroethylene using an isothermal separator. Typically, the trichloroethylene can be maintained below 10 ppm PCB.

Actual decontamination results are shown in the table below.

| | Askarel ® transformers | 10C oil transformers |
|---|---|---|
| Transformer Size | 5–2000 KVA | 45–1000 KVA |
| Initial PCB Concentrations, ppm | | |
| | 400,000–900,000 | 580–13,000 |
| EPA Permitted PCB Residual ($\mu g/100\ cm^2$) | | |
| | less than 10.0 | less than 10.0 |
| PCB Residual Range ($\mu g/100\ cm^2$) | | |
| Transformer Shell | 0.1–4.5 | less than 1.0 |
| Laminations | 0.1–2.5 | less than 1.0 |
| Windings | 0.1–2.1 | less than 1.0 |
| Average PCB Residual ($\mu g/100\ cm^2$) | | |
| Transformer Shell | 2.2 | less than 0.1 |

-continued

| | Askarel ® transformers | 10C oil transformers |
|---|---|---|
| Laminations | 0.9 | less than 0.1 |
| Windings | 1.1 | less than 0.1 |

For each 125 cubic foot transformer processed, approximately 438 lbs of copper and aluminum, 1275 lbs of steel casing and 1332 lbs of steel laminations are reclaimed rather than being buried. The majority of the remaining PCB contaminated solid waste (approximately 142 lbs) is combustible material that can be destroyed in an approved incinerator rather than being buried. Approximately 3 gallons of PCB containing liquids are removed or generated during the decontamination process. These PCBs can also be destroyed rather than being buried.

We claim:

1. A method for decontamination of PCB containing transformers comprising:

a. precleaning the transformer by vapor/degreasing using a solvent;

b. disassembly of the transformer;

c. mechanical removal of insulation form the transformer wire coils;

d. final cleaning of the transformer casing by vapor/degreasing using a solvent; and e. final cleaning of the transformer internal components by vapor/degreasing using a solvent combined with mechanical tumbling of the transformer internal components.

2. A method as in claim 1 wherein the solvent is trichloroethylene.

3. A method for decontamination of PCB components which comprises processing said PCB components through a plurality of vapor/degreasing compartments containing a solvent combined with mechanical tumbling of said PCB components, said compartments including a first compartment, an intermediate compartment and a last compartment, introducing clean solvent into said last compartment, permittiing partially contaminated solvent to overflow from said last compartment into said intermediate compartment, permitting contaminated solvent to overflow from said intermediate compartment into said first compartment and removing the most heavily contaminated solvent from said first compartment.

4. A method according to claim 1 wherein said final cleaning of said transformer internal components is effected by processing said transformer internal parts through a plurality of vapor/degreasing compartments containing a solvent combined with mechanical tumbling of said PCB components, said compartments including a first compartment, an intermediate compartment and a last compartment, introducing clean solvent into said last compartment, permitting partially contaminated solvent to overflow from said last compartment into said intermediate compartment, permitting contaminated solvent to overflow from said intermediate compartment into said first compartment and removing the most heavily contaminated solvent from said first compartment.

5. A method according to claims 3 or 4 wherein the solvent is trichloroethylene.

* * * * *